US010828646B2

(12) United States Patent
Rothenberg

(10) Patent No.: US 10,828,646 B2
(45) Date of Patent: Nov. 10, 2020

(54) ELECTROSTATIC AIR FILTER

(71) Applicant: PACIFIC AIR FILTRATION HOLDINGS, LLC, Redmond, WA (US)

(72) Inventor: Larry Rothenberg, Boulder, CO (US)

(73) Assignee: AGENTIS AIR LLC, Columbia, MD (US)

( * ) Notice: Subject to any disclaimer, the term of this patent is extended or adjusted under 35 U.S.C. 154(b) by 287 days.

(21) Appl. No.: 15/653,449

(22) Filed: Jul. 18, 2017

(65) Prior Publication Data

US 2018/0015481 A1 Jan. 18, 2018

Related U.S. Application Data

(60) Provisional application No. 62/493,804, filed on Jul. 18, 2016.

(51) Int. Cl.

| | |
|---|---|
| ***B03C 3/12*** | (2006.01) |
| ***B03C 3/49*** | (2006.01) |
| ***B03C 3/41*** | (2006.01) |
| ***B03C 3/36*** | (2006.01) |
| ***B03C 3/06*** | (2006.01) |
| ***B03C 3/60*** | (2006.01) |

(52) U.S. Cl.

CPC ..... *B03C 3/12* (2013.01); *B03C 3/06* (2013.01); *B03C 3/368* (2013.01); *B03C 3/41* (2013.01); *B03C 3/49* (2013.01); *B03C 3/60* (2013.01); *B03C 2201/04* (2013.01); *B03C 2201/10* (2013.01)

(58) Field of Classification Search

CPC combination set(s) only.
See application file for complete search history.

(56) References Cited

U.S. PATENT DOCUMENTS

| | | | | |
|---|---|---|---|---|
| 1,650,097 | A * | 11/1927 | Schmidt | B03C 3/60 96/95 |
| 1,931,436 | A * | 10/1933 | Deutsch | B03C 3/36 96/64 |
| 1,957,560 | A | 5/1934 | Thompson | |
| 2,142,129 | A * | 1/1939 | Wilhelm | B03C 3/12 96/66 |
| 2,271,597 | A | 2/1942 | Lionel | |
| 2,526,402 | A | 10/1950 | Palmer | |
| 2,571,079 | A | 10/1951 | Warburton | |
| 2,588,111 | A | 3/1952 | Gorden | |
| 2,672,207 | A | 3/1954 | Hedberg | |
| 2,771,963 | A | 11/1956 | Warren | |
| 2,997,130 | A | 8/1961 | Nodolf | |

(Continued)

FOREIGN PATENT DOCUMENTS

| | | |
|---|---|---|
| CN | 2319732 | 5/1999 |
| CN | 1926651 A | 3/2007 |

(Continued)

*Primary Examiner* — Christopher P Jones
*Assistant Examiner* — Sonji Turner
(74) *Attorney, Agent, or Firm* — Mark E. Ungerman; Ungerman IP PLLC

(57) ABSTRACT

An electronic air filter containing a tubular collecting electrode and an ion emitting electrode located concentrically inside of the tube-like collecting electrode, the collecting electrode consists of outer electrically conductive shell and inner layer made of open cell porous material.

10 Claims, 9 Drawing Sheets

(56) References Cited

U.S. PATENT DOCUMENTS 3,040,497 A 6/1962 Schwab
3,157,479 A * 11/1964 Boles ..... B03C 3/06 96/82
3,452,225 A 6/1969 Gourdine
3,504,482 A 4/1970 Goettl
3,518,462 A 6/1970 Brown
3,710,588 A 1/1973 Martinez
3,751,715 A 8/1973 Edwards
3,816,980 A 6/1974 Schwab
3,831,351 A 8/1974 Gibbs et al.
3,959,715 A 5/1976 Canning
3,960,505 A 6/1976 Marks
4,057,405 A 11/1977 Cheney et al.
4,077,785 A * 3/1978 Hartshorn ..... B03C 3/60 55/DIG. 38
4,098,591 A * 7/1978 van Diepenbroek ..... B03C 3/06 95/57
4,124,359 A 11/1978 Geller
4,160,202 A 7/1979 James et al.
4,166,729 A 9/1979 Thompson et al.
4,177,047 A * 12/1979 Goland ..... B03C 3/49 55/DIG. 38
4,178,156 A 12/1979 Tashiro et al.
4,231,766 A 11/1980 Spurgin
4,246,010 A 1/1981 Honacker
4,259,093 A 3/1981 Vlastos et al.
4,259,707 A 3/1981 Penney
4,264,343 A 4/1981 Natarajan et al.
4,290,003 A 9/1981 Lanese
4,390,830 A 6/1983 Laugesen
4,390,831 A 6/1983 Byrd et al.
4,433,281 A 2/1984 Herklotz et al.
4,486,704 A 12/1984 Gustafsson et al.
4,490,159 A 12/1984 Matts
4,516,991 A 5/1985 Kawashima
4,549,887 A 10/1985 Joannou
4,604,112 A * 8/1986 Ciliberti ..... B03C 3/06 55/302
4,613,346 A 9/1986 Reyes et al.
4,643,745 A 2/1987 Sakakibara et al.
4,673,416 A 6/1987 Sakakibara et al.
4,689,056 A 8/1987 Noguchi et al.
4,719,535 A 1/1988 Zhenjun et al.
4,789,801 A 12/1988 Lee
4,904,283 A * 2/1990 Hovis ..... B03C 3/155 96/66
4,980,796 A 12/1990 Huggins
5,035,728 A 7/1991 Fang
5,055,118 A 10/1991 Nagoshi et al.
5,068,811 A 11/1991 Johnston et al.
5,108,470 A 4/1992 Pick
5,123,524 A 6/1992 Lapeyre
5,251,171 A 10/1993 Yamauchi
5,254,155 A * 10/1993 Mensi ..... B03C 3/16 96/100
5,330,559 A 7/1994 Cheney et al.
5,332,485 A 7/1994 Thompson
5,332,562 A 7/1994 Kersey et al.
5,336,299 A 8/1994 Savell
5,395,430 A * 3/1995 Lundgren ..... B03C 3/06 96/83
5,466,279 A 11/1995 Hattori et al.
5,526,402 A 6/1996 Dent et al.
5,573,577 A 11/1996 Joannou
5,628,818 A 5/1997 Smith et al.
5,679,121 A 10/1997 Kim
5,689,177 A 11/1997 Nielsen et al.
5,707,428 A * 1/1998 Feldman ..... B03C 3/06 96/54
5,807,425 A 9/1998 Gibbs
5,827,407 A * 10/1998 Wang ..... B01D 53/32 204/164
5,846,302 A 12/1998 Putro
5,914,454 A 6/1999 Imbaro et al.
5,922,111 A * 7/1999 Omi ..... B03C 3/025 55/DIG. 38
5,993,521 A 11/1999 Loreth et al.
6,129,781 A 10/2000 Okamoto et al.
6,187,271 B1 2/2001 Lee et al.
6,245,131 B1 6/2001 Rippelmeyer et al.
6,251,171 B1 6/2001 Marra et al.
6,504,308 B1 1/2003 Krichtafovitch et al.
6,527,834 B1 3/2003 Jörder et al.
6,635,106 B2 10/2003 Katou et al.
6,656,248 B2 * 12/2003 Ilmasti ..... B03C 3/155 55/429
6,660,061 B2 * 12/2003 Josephson ..... B01D 46/2451 55/282.3
6,764,533 B2 7/2004 Lobiondo
6,790,259 B2 9/2004 Rittri et al.
6,805,732 B1 10/2004 Billiotte et al.
6,831,271 B1 12/2004 Guevremont et al.
6,937,455 B2 8/2005 Krichtafovitch et al.
6,984,987 B2 1/2006 Taylor et al.
7,008,469 B2 3/2006 Vetter et al.
7,019,244 B2 3/2006 Weaver et al.
7,048,780 B2 5/2006 Kim et al.
7,112,238 B2 9/2006 Joannou
7,150,780 B2 12/2006 Krichtafovitch et al.
7,182,805 B2 2/2007 Reaves
7,264,659 B1 9/2007 Moshenrose
7,316,735 B2 * 1/2008 Tomimatsu ..... B03C 3/41 55/DIG. 38
7,332,019 B2 2/2008 Bias et al.
7,351,274 B2 4/2008 Helt et al.
7,393,385 B1 7/2008 Coffey et al.
7,405,672 B2 7/2008 Taylor et al.
7,431,755 B2 10/2008 Kobayashi et al.
7,438,743 B2 10/2008 Strauss
7,452,410 B2 11/2008 Bergeron et al.
7,513,933 B2 4/2009 Coppom et al.
7,531,027 B2 5/2009 Tepper et al.
7,531,028 B2 5/2009 Mello et al.
7,534,288 B2 5/2009 Bromberg
7,553,353 B2 6/2009 Lepage
7,569,100 B2 8/2009 Tanaka et al.
7,582,144 B2 * 9/2009 Krigmont ..... B03C 3/025 96/16
7,582,145 B2 * 9/2009 Krigmont ..... B03C 3/025 55/DIG. 38
7,597,750 B1 * 10/2009 Krigmont ..... B03C 3/014 55/DIG. 38
7,608,135 B2 10/2009 Mello et al.
7,717,980 B2 5/2010 Tepper et al.
7,736,418 B2 6/2010 Graiβ
7,753,994 B2 7/2010 Motegi et al.
7,758,675 B2 * 7/2010 Naito ..... B01D 53/32 55/DIG. 38
7,780,761 B2 8/2010 Gu et al.
7,815,719 B2 10/2010 McKinney et al.
7,833,322 B2 11/2010 Botvinnik et al.
7,857,884 B2 12/2010 Bohlen
7,857,890 B2 12/2010 Paterson et al.
7,896,957 B2 3/2011 Zhao et al.
7,914,604 B2 3/2011 Mello et al.
7,942,952 B2 5/2011 Gale
7,998,255 B2 8/2011 Blum
8,043,412 B2 10/2011 Carlson
8,049,426 B2 11/2011 Krichtafovitch et al.
8,092,768 B2 1/2012 Miller et al.
8,211,208 B2 7/2012 Chan et al.
8,241,396 B2 8/2012 Ursem et al.
8,241,397 B2 8/2012 Gu et al.
8,277,541 B2 10/2012 Hunt et al.
8,278,797 B2 10/2012 Sashida
8,349,052 B2 1/2013 Noh et al.
8,357,233 B2 1/2013 Chan
8,366,813 B2 2/2013 Tokuda et al.
8,388,900 B2 3/2013 Benedek et al.
8,404,020 B2 3/2013 Farmer et al.
8,414,687 B2 4/2013 Li
8,454,733 B2 6/2013 Tanaka et al.

(56) References Cited

U.S. PATENT DOCUMENTS

| | | | | |
|---|---|---|---|---|
| 8,460,433 | B2 | 6/2013 | Gefter et al. | |
| 8,492,733 | B1 | 7/2013 | Klochkov et al. | |
| 8,506,674 | B1 | 8/2013 | Brown-Fitzpatrick et al. | |
| 8,551,228 | B2 | 10/2013 | Chan | |
| 8,574,345 | B2 | 11/2013 | Ursem et al. | |
| 8,608,826 | B2 | 12/2013 | Ai-Hamouz | |
| 8,608,838 | B2 * | 12/2013 | Wong | B03C 3/025 55/DIG. 38 |
| 8,623,116 | B2 | 1/2014 | Karlsson | |
| 8,624,476 | B2 | 1/2014 | Sekoguchi | |
| 8,663,362 | B2 | 3/2014 | Hagan | |
| 8,690,996 | B2 | 4/2014 | Ji et al. | |
| 8,702,848 | B2 | 4/2014 | Kulprathipanja et al. | |
| 8,721,775 | B2 | 5/2014 | Chesebrough | |
| 8,736,043 | B2 | 5/2014 | Konno et al. | |
| 8,741,018 | B2 | 6/2014 | Belcher et al. | |
| 8,760,830 | B2 | 6/2014 | Ikeda | |
| 8,845,782 | B2 | 9/2014 | Metteer | |
| 8,873,215 | B2 | 10/2014 | Waddell | |
| 8,920,537 | B2 | 12/2014 | Seike | |
| 8,999,040 | B2 | 4/2015 | Johansson | |
| 9,028,588 | B2 | 5/2015 | Hess | |
| 9,089,849 | B2 | 7/2015 | Gu et al. | |
| 9,216,233 | B2 | 12/2015 | Ota et al. | |
| 9,308,537 | B2 | 4/2016 | Krichtafovitch | |
| 9,308,538 | B2 | 4/2016 | Genereux et al. | |
| 9,327,293 | B2 | 5/2016 | McKinney et al. | |
| 9,387,487 | B2 | 7/2016 | McGrath | |
| 9,441,845 | B2 | 9/2016 | Waddell | |
| 9,453,651 | B2 | 9/2016 | Park et al. | |
| 9,457,118 | B2 | 10/2016 | Ota et al. | |
| 9,488,382 | B2 | 11/2016 | Krichtafovitch | |
| 9,550,189 | B2 | 1/2017 | Oertmann | |
| 9,630,186 | B2 | 4/2017 | Back | |
| 9,797,864 | B2 | 10/2017 | McKinney | |
| 9,827,573 | B2 | 11/2017 | Afanasiev et al. | |
| 10,168,059 | B2 | 1/2019 | Yamaguchi et al. | |
| 2002/0134932 | A1 | 9/2002 | Guevremont et al. | |
| 2002/0152890 | A1 | 10/2002 | Leiser | |
| 2002/0190658 | A1 | 12/2002 | Lee | |
| 2003/0131727 | A1 | 7/2003 | Fissan et al. | |
| 2004/0023411 | A1 | 2/2004 | Fenn | |
| 2004/0105802 | A1 | 6/2004 | Duncan et al. | |
| 2004/0212329 | A1 | 10/2004 | Krichtafovitch et al. | |
| 2006/0177356 | A1 | 8/2006 | Miller | |
| 2006/0185511 | A1 | 8/2006 | Tepper | |
| 2006/0278074 | A1 | 12/2006 | Tseng et al. | |
| 2006/0278082 | A1 * | 12/2006 | Tomimatsu | B03C 3/41 96/66 |
| 2006/0286017 | A1 | 12/2006 | Hakka | |
| 2007/0028767 | A1 | 2/2007 | Choi et al. | |
| 2007/0148061 | A1 | 6/2007 | Lau et al. | |
| 2008/0030920 | A1 | 2/2008 | Krichtafovitch et al. | |
| 2008/0092743 | A1 | 4/2008 | Taylor et al. | |
| 2008/0121106 | A1 | 5/2008 | Tepper et al. | |
| 2008/0282772 | A1 | 11/2008 | Petinarides | |
| 2009/0114090 | A1 | 5/2009 | Gu et al. | |
| 2009/0235817 | A1 | 9/2009 | Gu et al. | |
| 2009/0235821 | A1 | 9/2009 | Mochizuki et al. | |
| 2009/0320426 | A1 | 12/2009 | Braunecker et al. | |
| 2010/0051709 | A1 | 3/2010 | Krichtafovitch et al. | |
| 2010/0089240 | A1 | 4/2010 | Krichtafovitch | |
| 2010/0095848 | A1 | 4/2010 | Chang et al. | |
| 2010/0155025 | A1 | 6/2010 | Jewell-Larsen et al. | |
| 2010/0229724 | A1 | 9/2010 | Tokuda et al. | |
| 2010/0236411 | A1 | 9/2010 | Chan | |
| 2011/0084611 | A1 | 4/2011 | Schlitz et al. | |
| 2011/0286892 | A1 | 11/2011 | Taylor et al. | |
| 2012/0073436 | A1 | 3/2012 | Li | |
| 2013/0021715 | A1 | 1/2013 | Jewell-Larsen et al. | |
| 2013/0047857 | A1 | 2/2013 | Bohlen | |
| 2013/0047858 | A1 | 2/2013 | Bohlen et al. | |
| 2013/0047859 | A1 | 2/2013 | Bohlen | |
| 2013/0074690 | A1 * | 3/2013 | Tomimatsu | B01D 46/02 95/26 |
| 2013/0098247 | A1 | 4/2013 | Chan | |
| 2013/0220128 | A1 | 8/2013 | Gu et al. | |
| 2013/0276417 | A1 | 10/2013 | Winters et al. | |
| 2013/0284025 | A1 | 10/2013 | Johansson et al. | |
| 2014/0150659 | A1 | 6/2014 | McGrath | |
| 2014/0174294 | A1 | 6/2014 | Krichtafovitch | |
| 2014/0345463 | A1 | 11/2014 | Urata et al. | |
| 2014/0373717 | A1 | 12/2014 | Wang | |
| 2015/0013541 | A1 | 1/2015 | Vandenbelt et al. | |
| 2015/0059580 | A1 | 3/2015 | Clement et al. | |
| 2015/0246595 | A1 | 9/2015 | Forejt et al. | |
| 2015/0260147 | A1 | 9/2015 | Schenk et al. | |
| 2015/0323217 | A1 | 11/2015 | Krichtafovitch | |
| 2016/0013013 | A1 | 1/2016 | Waddell | |
| 2016/0184834 | A1 | 6/2016 | Genereux et al. | |
| 2016/0236205 | A1 | 8/2016 | Seeley et al. | |
| 2017/0008008 | A1 | 1/2017 | Umase | |
| 2017/0072406 | A1 | 3/2017 | Yamaguchi et al. | |
| 2017/0354977 | A1 | 12/2017 | Krichtafovitch | |
| 2017/0354979 | A1 | 12/2017 | Krichtafovitch | |
| 2017/0354980 | A1 | 12/2017 | Krichtafovitch | |
| 2017/0354981 | A1 | 12/2017 | Krichtafovitch | |
| 2018/0015482 | A1 | 1/2018 | Rothenberg et al. | |

FOREIGN PATENT DOCUMENTS

| | | | |
|---|---|---|---|
| CN | 100552854 | | 10/2009 |
| CN | 101657247 | B | 6/2013 |
| CN | 103706479 | A | 4/2014 |
| CN | 105034756 | A | 11/2015 |
| CN | 205066003 | U | 3/2016 |
| DE | 4114935 | A1 | 11/1991 |
| EP | 0332624 | B1 | 1/1992 |
| EP | 2700452 | A2 | 2/2014 |
| GB | 1490315 | A | 11/1977 |
| WO | 2010025811 | A1 | 3/2010 |
| WO | 2012039826 | A3 | 8/2012 |
| WO | 2013173528 | A1 | 11/2013 |
| WO | 2015084112 | A1 | 6/2015 |

* cited by examiner

ELECTROSTATIC AIR FILTER

CROSS-REFERENCE AND RELATED APPLICATIONS

This application claims priority from and the benefit of the filing date of U.S. Provisional Application No. 62/493,804 filed on Jul. 18, 2016, the disclosure of which is expressly incorporated herein by reference in its entirety.

BACKGROUND OF THE INVENTION

1. Field of the Invention

The present invention relates generally to cleaning gas flows using electrostatic air filters and associated systems and methods. In particular, several embodiments are directed toward electrostatic air filters for use in highly contaminated atmospheres.

2. Description of the Related Technology

Electrostatic air filters may be single stage or two stage devices. One-stage electrostatic air filters generally contain a corona electrode and a collecting electrode. The collecting electrodes are commonly made to be plate-like, flat, or corrugated plates or tubes. When sufficient electrical potential difference on the order of kilovolts or tens of kilovolts is applied between those electrodes, the corona discharge takes place and ions are emitted from the corona electrodes. These ions travel toward the collecting electrodes. Dust particulates in the air become charged with the ions, and thus carry the electrical charge by themselves. When electrically charged particles reach the collecting electrodes, they settle there while clean air continues to pass further.

Two-stage electrostatic air filters generally have four kinds of electrodes. The corona electrodes and exciting electrodes form an ionization stage located at the air inlet. The electrical potential difference of several kilovolts or tens of kilovolts is applied between the corona electrode and the exciting electrode in order to generate the corona discharge. The collecting and repelling electrodes form a collecting stage. The collecting electrodes are commonly made to be flat or corrugated plates parallel to each other and spaced from each other. The repelling electrodes are commonly made to be flat or corrugated plates parallel to each other and located between the collecting electrodes. An electrical potential difference of several kilovolts or tens of kilovolts is applied between the collecting and repelling electrodes. The electric field is therefore formed in the area between the collecting and repelling electrodes. Ions are emitted by the ionization stage and charge particles passing through this stage toward the collecting electrodes. When charged particles enter the area between the collecting and repelling electrodes, these particles are pushed toward the collecting electrodes by the electric force between those electrodes, and may settle on the surface of the collecting electrodes.

There is a class of electrostatic filters with tube-like collecting electrodes. The tubes may be of round, or hexagonal, or other suitable shape with the oppositely charged electrode located inside of the tube. This oppositely charged electrode may serve as a corona electrode, or as a repelling electrode, or in both of those capacities.

The disadvantage of existing tube-like collecting electrodes is their poor ability to hold large amount of contaminants. When dust layer becomes rather thick the collecting electrodes lose their ability to collect more particles and need cleaning. Tube-like electrodes cleaning is cumbersome and expensive procedure. In highly contaminated atmosphere, like in industrial and fabrication areas.

SUMMARY OF THE INVENTION

According to an advantageous feature of the invention, a tubular or tube-like collecting electrode may include two concentric parts. An outer part may be made of metal of other slightly electrically conductive material. An inner part may be made of open cell foam. This foam may have several millimeters thickness and is capable of collecting a much greater amount of the contaminants than a flat metal surface due to the high collecting area.

According to another feature of the invention, a tubular collecting electrode may be made of flexible electrically conductive material, like carbon impregnated rubber. An advantage of this implementation is that it may be used for clean air delivery to hard-to-reach places. A flexible tube may be used as a part of air-cleaning mask. Inside of such tube the oppositely charged electrode (like a thin wire or a barbed wire) may be located. In this case special features keeping the wire near the center of the tube may be used.

According to still another feature of the invention, a number of tubular collecting electrodes may be assembled to a honey-comb like structure. In this case oppositely charged electrodes may be located near the center and along with the collecting electrodes. Again, the collecting electrodes may have an outer conductive part (shell) and inner foam-like collecting part. The foam is preferably not electrically conductive but should keep open-cell structure.

Moreover, the above objects and advantages of the invention are illustrative, and not exhaustive, of those that can be achieved by the invention. Thus, these and other objects and advantages of the invention will be apparent from the description herein, both as embodied herein and as modified in view of any variations which will be apparent to those skilled in the art.

DETAILED DESCRIPTION OF THE PREFERRED EMBODIMENT

Before the present invention is described in further detail, it is to be understood that the invention is not limited to the particular embodiments described, as such may, of course, vary. It is also to be understood that the terminology used herein is for the purpose of describing particular embodiments only, and is not intended to be limiting, since the scope of the present invention will be limited only by the appended claims.

Where a range of values is provided, it is understood that each intervening value, between the upper and lower limit of that range and any other stated or intervening value in that stated range is encompassed within the invention. The upper and lower limits of these smaller ranges may independently be included in the smaller ranges is also encompassed within the invention, subject to any specifically excluded limit in the stated range. Where the stated range includes one or both of the limits, ranges excluding either or both of those included limits are also included in the invention.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, a limited number of the exemplary methods and materials are described herein.

It must be noted that as used herein and in the appended claims, the singular forms "a", "an", and "the" include plural referents unless the context clearly dictates otherwise.

All publications mentioned herein are incorporated herein by reference to disclose and describe the methods and/or materials in connection with which the publications are cited. The publications discussed herein are provided solely for their disclosure prior to the filing date of the present application. Nothing herein is to be construed as an admission that the present invention is not entitled to antedate such publication by virtue of prior invention. Further, the dates of publication provided may be different from the actual publication dates, which may need to be independently confirmed.

The invention is described in detail with respect to preferred embodiments, and it will now be apparent from the foregoing to those skilled in the art that changes and modifications may be made without departing from the invention in its broader aspects, and the invention, therefore, as defined in the claims, is intended to cover all such changes and modifications that fall within the true spirit of the invention.

Figure 1:
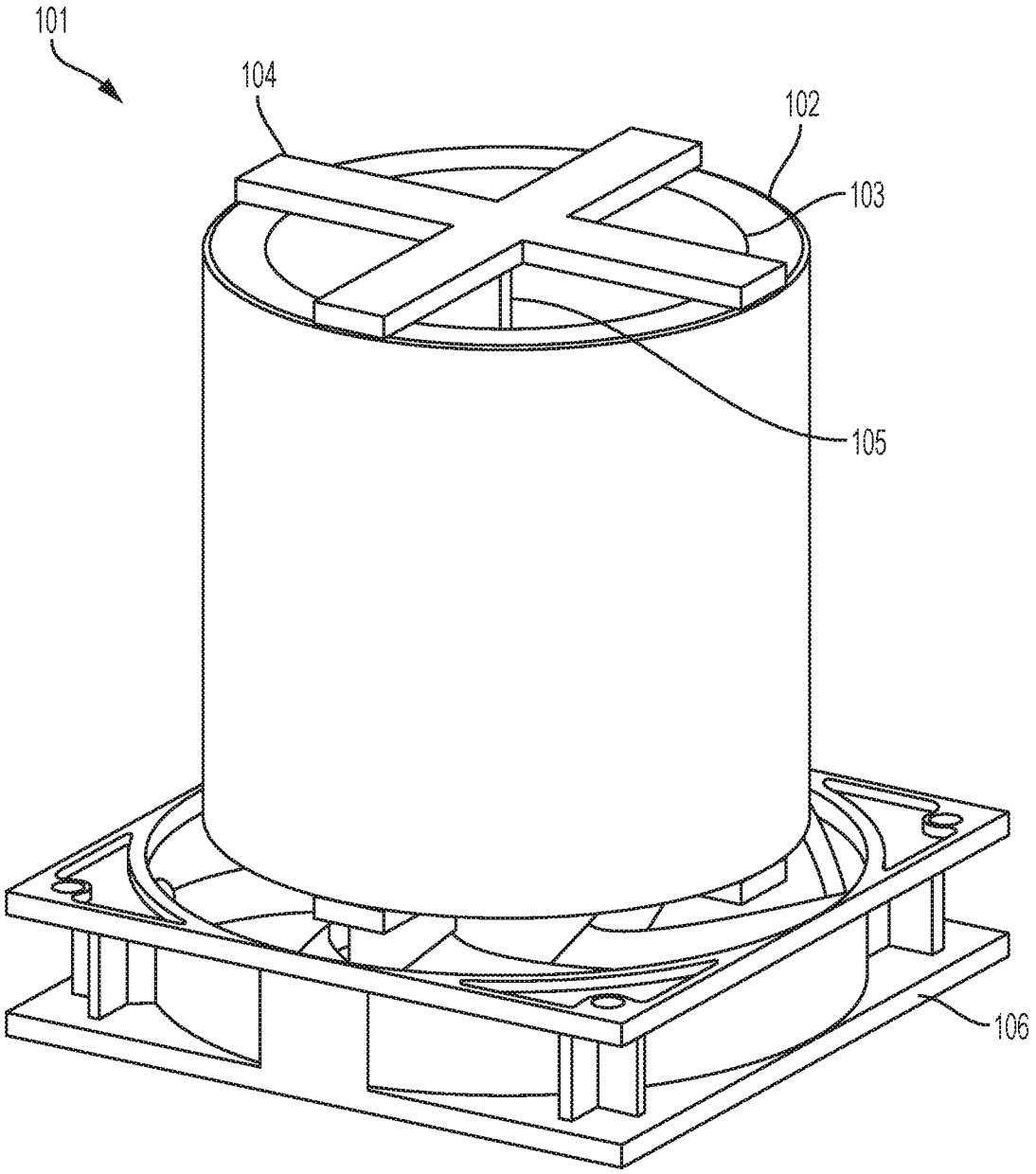
FIG. 1 shows the schematics of an embodiment of the invention.

Referring to FIG. 1, the proposed electrostatic air filter 101 is schematically shown with tubular collecting electrodes with outer electrically conductive layer 102 and inner foam-like layer 103. It also contains wire-like electrode 105 that is supported by non-conductive support 104. A fan 106 may provide air movement downward.

A potential difference may be applied between the corona electrode 105 and the electrically conductive outer shell 102. The outer shell 102 may be kept at ground potential and the corona wire may be placed under positive potential in the order of several kilovolts, and even tens of kilovolts. This electrical potential may be higher than corona onset voltage but lower than breakdown voltage.

When dirty air enters the electrostatic filter 101 from the top, the particles contained in the air become electrically charged by the ions emitted from the corona electrode 105. Charged particles are attracted to the electrode 102 and are driven toward this electrode. These charged particles may reach the open cell foam inner layer 103 and may be trapped there.

After long period of air cleaning the pores of the inner layer 103 may become filled and the inner layer may require replacement. Since outer layer 102 may be made of cheap electrically conductive material, like aluminum foil or metallized film the whole electrode assembly 102-103 may be disposed and replaced with a clean one.

Figure 2:
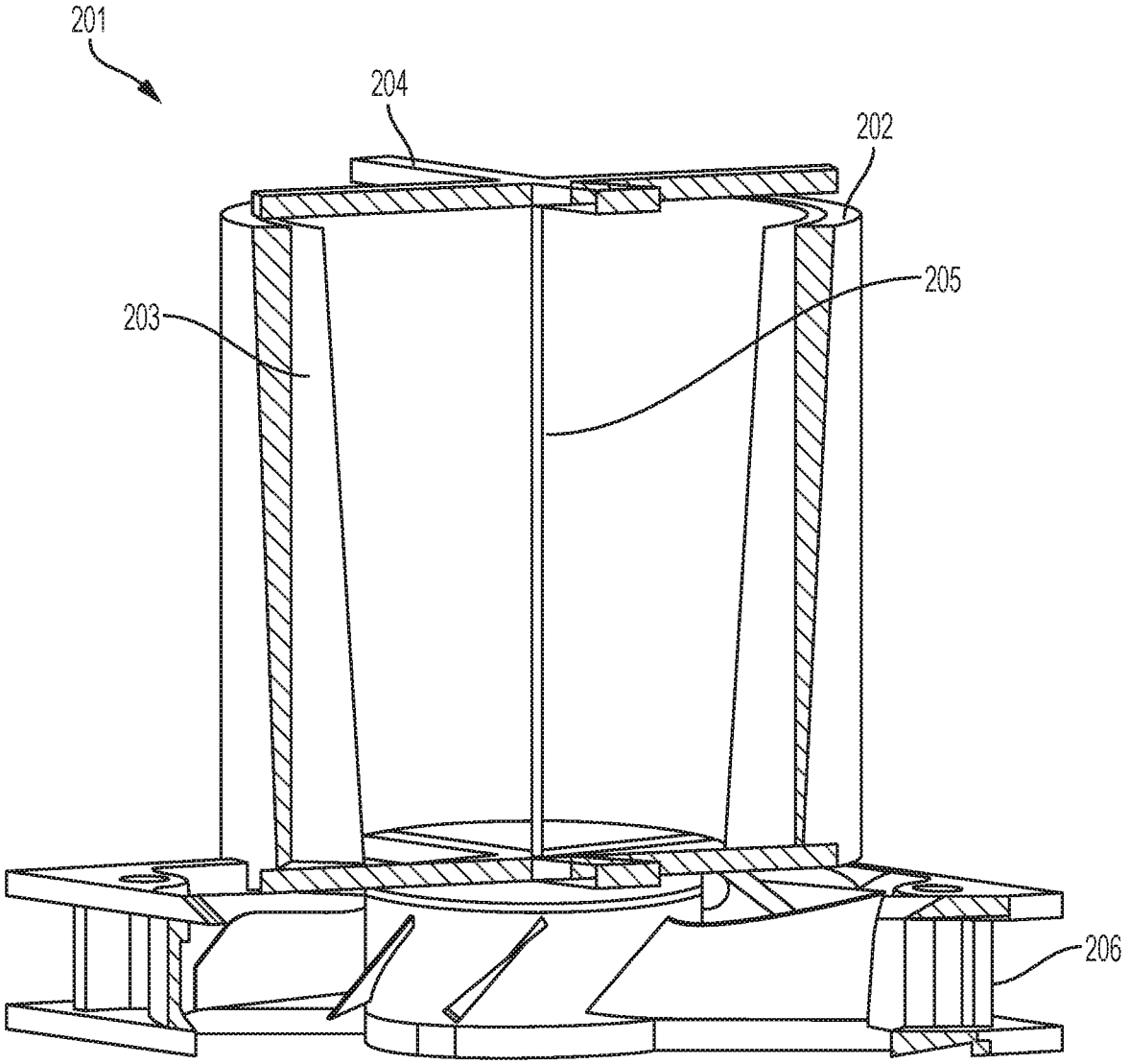
FIG. 2 shows an embodiment of the invention in cross section.

FIG. 2 shows the electrostatic air filter 201 of FIG. 1 (analogous to 101) in cross section. The air may enter the tubes 202-203 from the top driven by the fan 206. The corona electrode 205 may be supported by the cross supports 204 (one is shown on the top and another on the bottom). In this electrostatic air filter the corona electrode 205 may serve as the corona electrode and the repelling electrode simultaneously.

Figure 3:
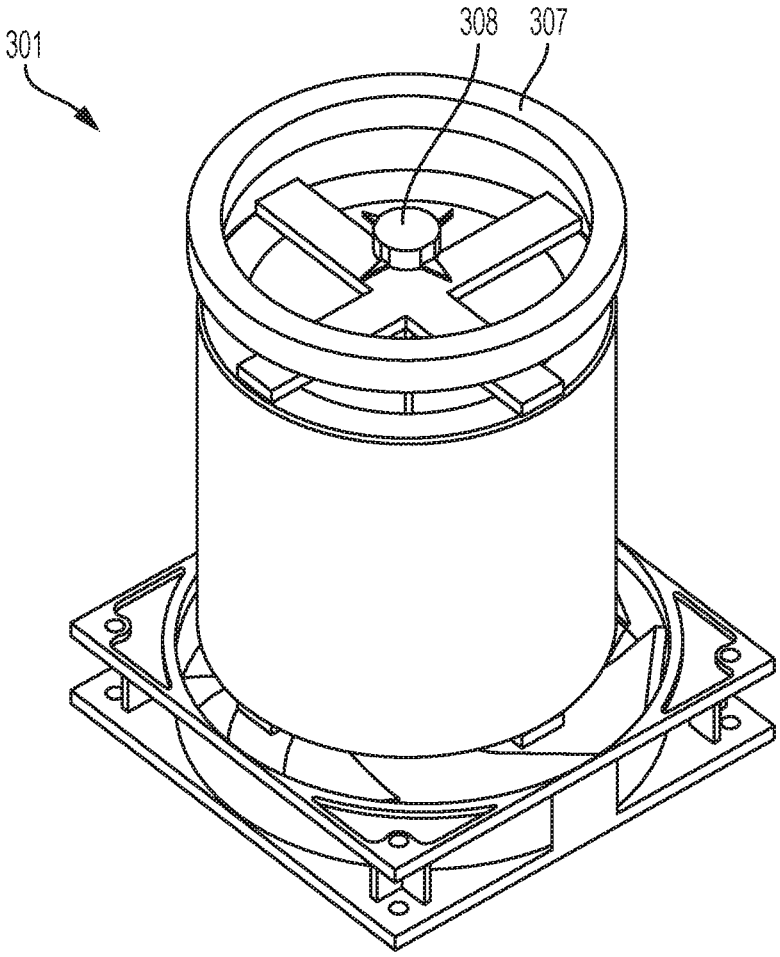
FIG. 3 shows an embodiment of FIG. 2 with a separate ionizer.

FIG. 3 shows a similar electrostatic filter 301. It shows an ionizer located at the inlet side of the filter. The ionizer may contain ion emitter 308 and ring-like exciting electrode 307. The ion emitter 308 may have some sharp points like needles, or a razor, or barbs. High potential difference may be applied between the ion emitter 308 and the ring-like exciting electrode 307.

In this arrangement, the wire (analogous to 105 and 205) shown within the tube may also be placed under high electrical potential with respect to the collecting electrode. This electrical potential may be lower than the corona onset voltage and the wire (or small diameter tube, or a bar) serve only as a repelling electrode. Such an arrangement allows reduced power consumption and decreased ozone generation.

Figure 4:
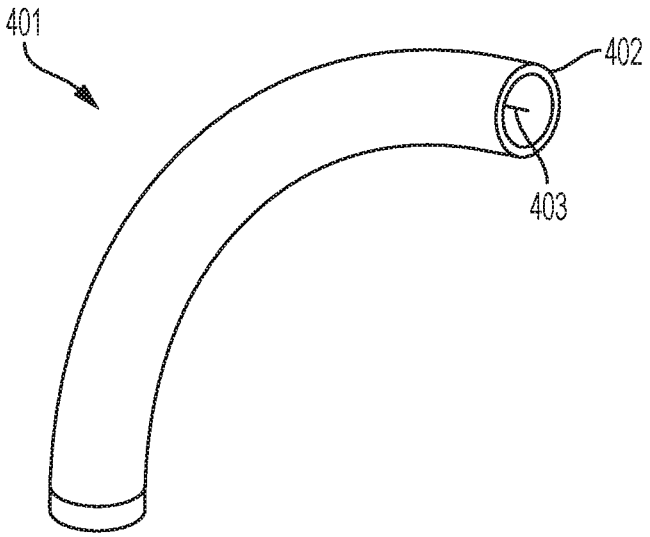
FIG. 4 shows an embodiment of the invention with flexible electrodes.

FIG. 4 schematically shows another embodiment of the proposed invention. The electrostatic air filter 401 may contain a collecting electrode 402 and a wire or wire-like electrode 403 located coaxially with respect to the collecting electrodes 402. Collecting electrode 402 may be made of flexible electrically conductive material (outer layer) with inner foam-like layer. Wire-like electrode 403 may be supported in the center of collecting electrode 402 by non-conductive supports (not shown). Such embodiment may be used to deliver clean air deliver to hard-to-reach places or along curved passages.

Figure 5:
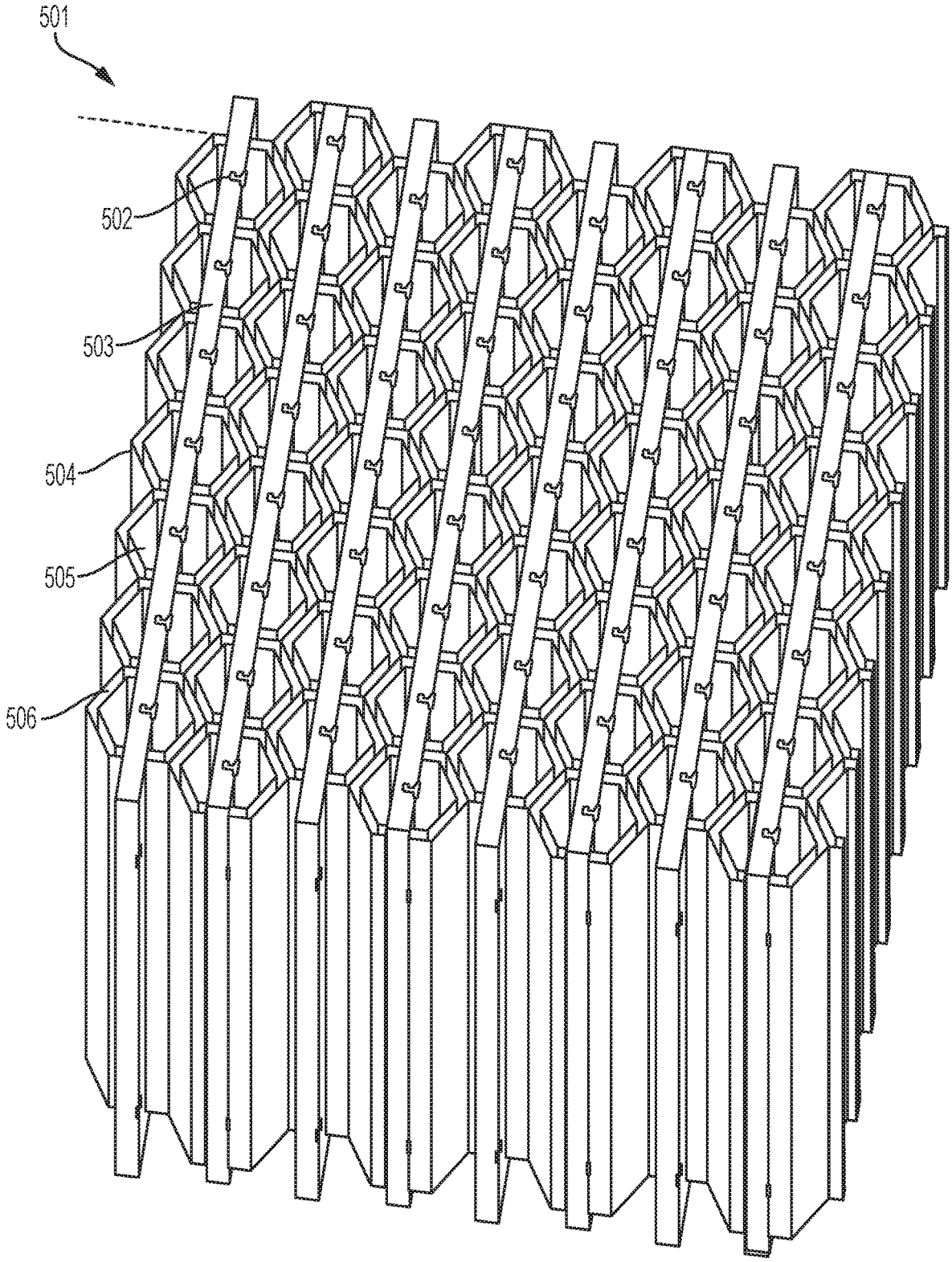
FIG. 5 shows a multiple-electrode embodiment of an assembled position.

FIG. 5 shows a multiple-electrode embodiment. The electrostatic filter 501 may include one or more hexagonally shaped collecting electrodes 506. Each of the collecting electrodes 506 may have an outer electrically conductive surface 504 and inner collecting layer 505. The collecting layer may be foam or foam-like and may be an open cell layer. The collecting layer 505 may be non-conductive or have a high resistivity and may, for example, be melamine. The wire-like electrode 502 may be located inside each collecting electrode. The frames 503 may support electrodes 502. The tubular collecting electrodes 506 may be assembled in a honeycomb configuration.

Figure 6:
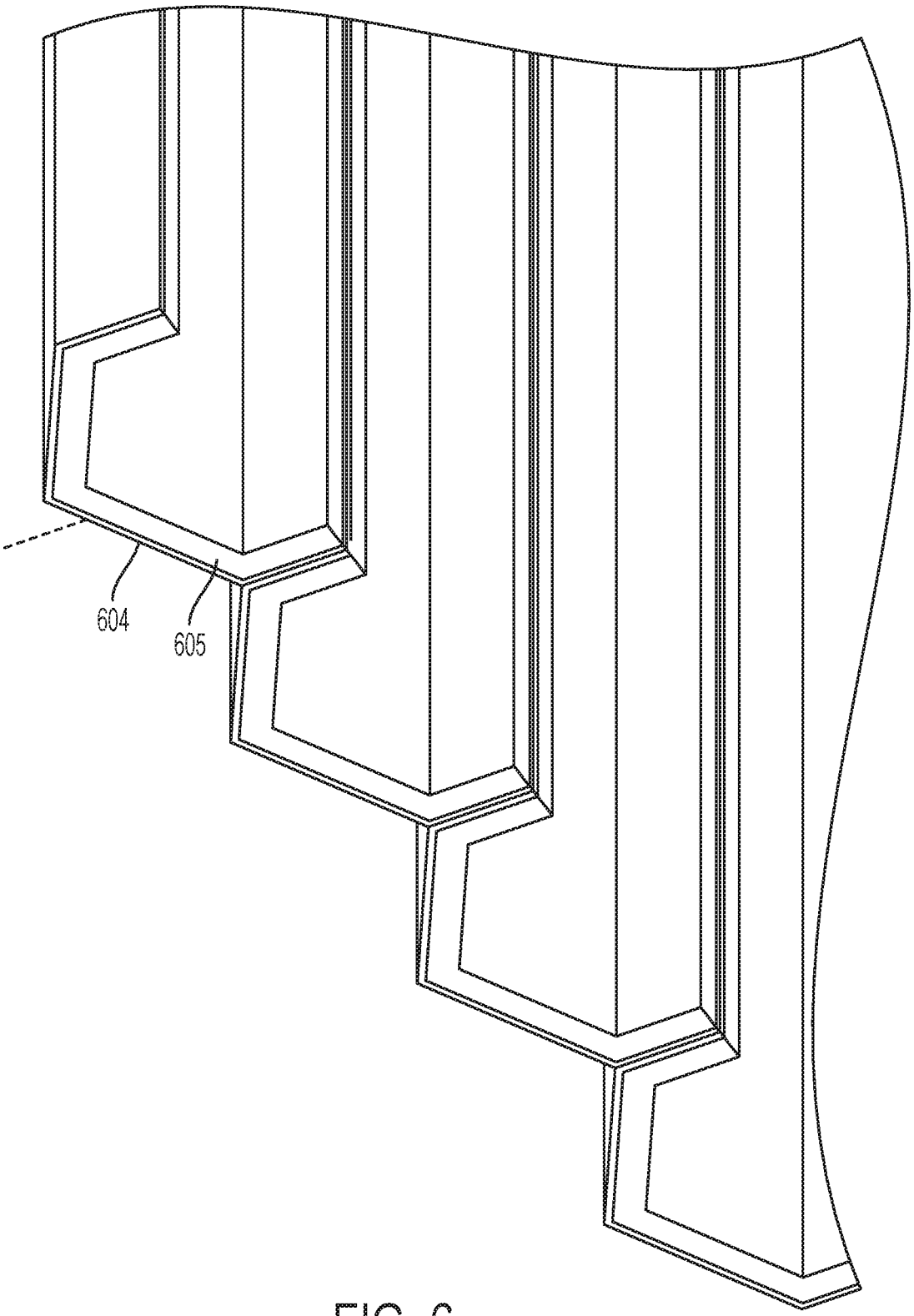
FIG. 6 shows the collecting electrodes of a multiple-electrode embodiment.

FIG. 6 shows a close up cross-section view of the collecting electrodes of the multiple-electrode embodiment shown in the FIG. 5. The collecting electrodes may be in two halves (one half is shown). Each half of the collecting electrodes may have an outer electrically conductive shell 604 and inner foam-like dust collecting layer 605. The dust collecting layer 605 is preferably non-conductive porous material with open cell structure. The outer shells 604 may be made in such a manner that when two of those halves are connected together the outer shells 604 make an electrical contact to each other.

Figure 7:
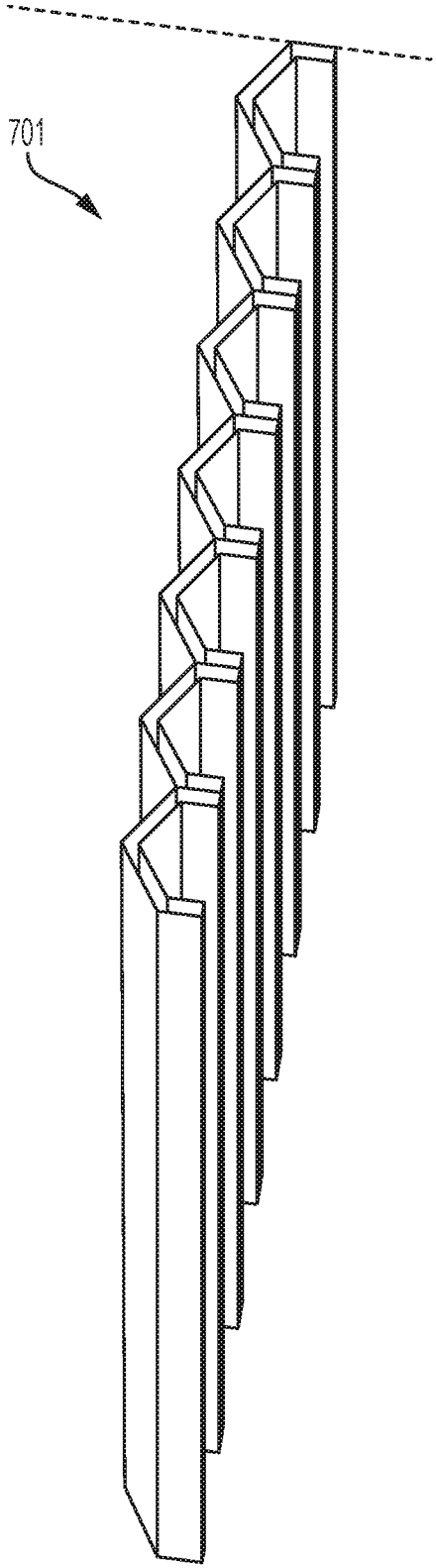
FIG. 7 shows the first stage of an assembly process of a multiple-electrode embodiment.

The multiple-electrode embodiment of FIG. 5 may be constructed in a multiple-stage process. FIG. 7 shows the multiple-electrode embodiment of the embodiment shown in the FIG. 5 after a first stage of the construction process. A plurality of half-shells may be assembled in a row 701. The assembled row may include several half shells mechanically and electrically connected to each other. Those half shells

701 may be glued or welded to each other to form a single solid structure. The outmost wall (the closest and the furthest) may be supported by a common vertical fixture (not shown).

Figure 8:
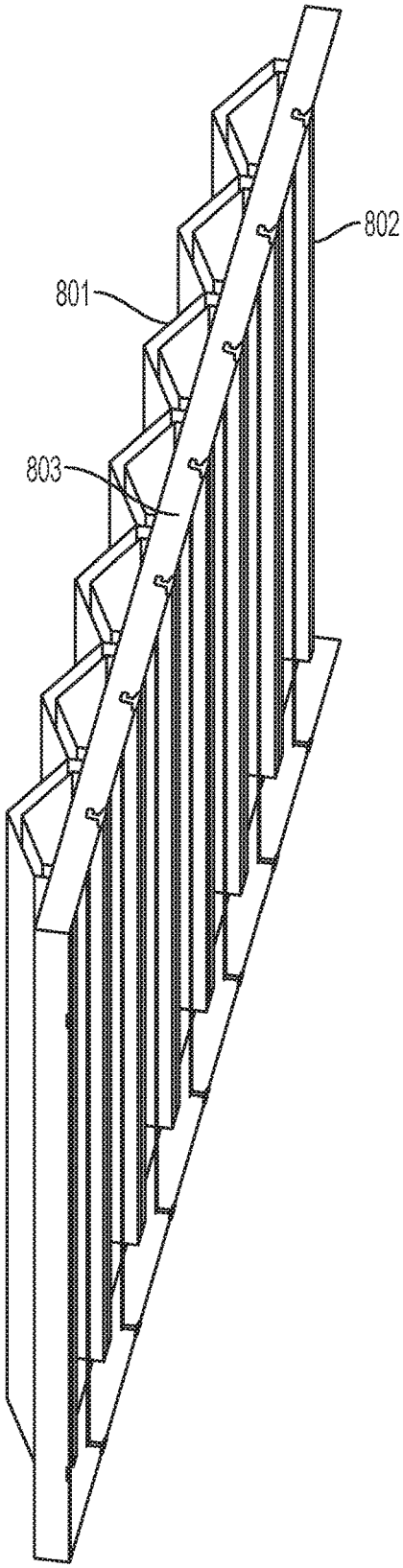
FIG. 8 shows the second stage of an assembly process of a multiple-electrode embodiment.

FIG. 8 shows a partially constructed multiple-electrode in a second stage of the assembly process of the multiple-electrode embodiment shown in the FIG. 5. The wire supports 803 (top and bottom) with the corona wires 802 may be are added to the solid structure 801 shown in the FIG. 7 as 701. The wire supports 803 may be supported by a horizontal fixture (not shown). The vertical fixture mentioned in description of FIG. 7 and the horizontal fixture mentioned in the description of the FIG. 8 may be connected to a common cabinet or case.

Figure 9:
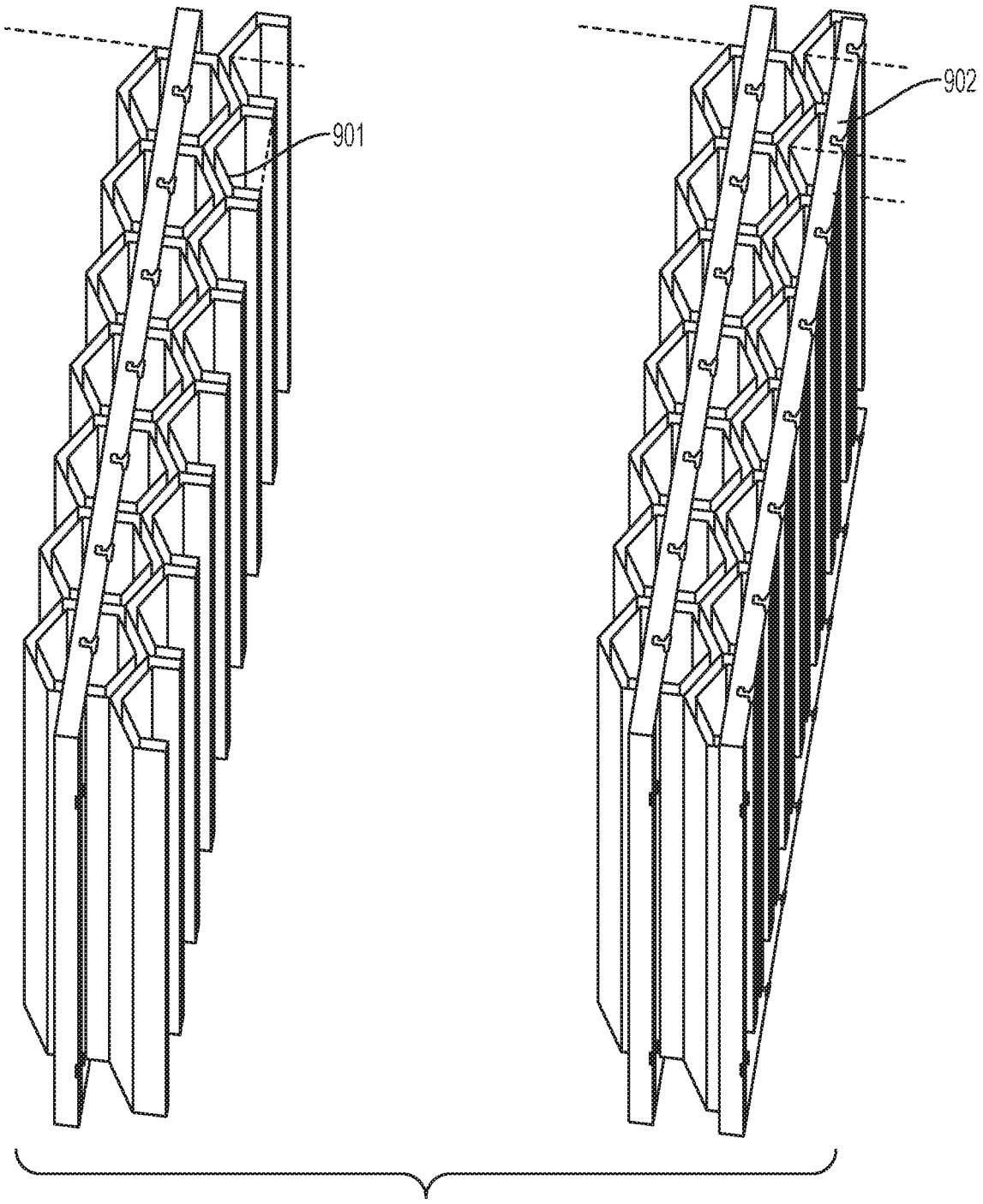
FIG. 9 shows the third and fourth stages of an assembly process of a multiple-electrode embodiment.

FIG. 9 shows a partially constructed multiple-electrode at a third and fourth stage of the assembly process of a multiple-electrode embodiment. In the third stage, two more half shells 901 of the collecting electrodes may be added and supported by the vertical fixtures mentioned earlier. In the fourth stage of the assembly process another corona wire support 902 may be added. This process continues until the whole assembly shown in the FIG. 5 is finished.

Thus, the specific systems and methods for the electrostatic air filter have been disclosed. It should be apparent, however, to those skilled in the art that many more modifications besides those already described are possible without departing from the inventive concepts herein. The inventive subject matter, therefore, is not to be restricted except in the spirit of the disclosure. Moreover, in interpreting the disclosure, all terms should be interpreted in the broadest possible manner consistent with the context. In particular, the terms "contains" and "containing" should be interpreted as referring to members, or components in a non-exclusive manner, indicating that the referenced elements and components, may be present, or utilized, or combined with other members and components that are not expressly referenced.

The invention claimed is:

1. An electrostatic air filter comprising:

a tubular collecting electrode;

an ion emitting electrode located coaxially inside said tubular collecting electrode, wherein said tubular collecting electrode includes a tubular electrically conductive layer and an inner open cell porous layer inside said tubular electrically conductive layer.

2. The electrostatic air filter according to claim 1, wherein said ion emitting electrode is a thin wire.

3. The electrostatic air filter according to claim 1, wherein said ion emitting electrode has sharp ion emitting components.

4. The electrostatic air filter according to claim 3, wherein said sharp ion emitting components are barbs.

5. The electrostatic air filter according to claim 1, wherein said tubular collecting electrode is a flexible tubular collecting electrode and said ion emitting electrode is centered within said flexible tubular electrode.

6. The electrostatic air filter according to claim 5, further comprising non-conductive supports between said tubular collecting electrode and said ion emitting electrode.

7. The electrostatic air filter according to claim 1, further comprising an ionizer located at an inlet side of said collecting electrode.

8. The electrostatic air filter according to claim 1, further comprising a plurality of tubular collecting electrodes, each having an ion emitting electrode; and wherein said plurality of tubular electrodes are assembled in a honeycomb configuration.

9. The electrostatic air filter according to claim 8, wherein said collecting electrodes are supported by walls and said ion emitting electrodes are supported by non-conductive supports.

10. The electrostatic air filter according to claim 9, further comprising non-conductive media separating said walls.

* * * * *